US010590830B1

(12) United States Patent
Candela et al.

(10) Patent No.: US 10,590,830 B1
(45) Date of Patent: Mar. 17, 2020

(54) INTERNAL COMBUSTION ENGINE INCLUDING PISTON COOLING JETS

(71) Applicant: GM Global Technology Operations LLC, Detroit, MI (US)

(72) Inventors: Giorgio Candela, Turin (IT); Fabio Numidi, Agliè (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/168,187

(22) Filed: Oct. 23, 2018

(51) Int. Cl.
*F01P 3/08* (2006.01)
*F01P 7/14* (2006.01)
*F02F 3/22* (2006.01)

(52) U.S. Cl.
CPC ..... *F01P 3/08* (2013.01); *F01P 7/14* (2013.01); *F02F 3/22* (2013.01); *F01P 2007/146* (2013.01)

(58) Field of Classification Search
CPC ..... F01P 3/08; F01P 7/14; F01P 2007/146; F02F 3/22
See application file for complete search history.

(56) References Cited

U.S. PATENT DOCUMENTS 8,997,698 B1 * 4/2015 Roth ..... F01P 3/08 123/41.35
2015/0240699 A1 8/2015 Candela et al.

FOREIGN PATENT DOCUMENTS

GB 770724 A * 3/1957 ..... F01P 3/08
WO WO-2015019697 A1 * 2/2015

* cited by examiner

*Primary Examiner* — Jacob M Amick
*Assistant Examiner* — Charles Brauch
(74) *Attorney, Agent, or Firm* — Cantor Colburn LLP

(57) ABSTRACT

An internal combustion engine (ICE) including an engine block including a plurality of cylinders, a piston arranged in each of the plurality of cylinders, and a piston cooling jet (PCJ) mounted to direct a flow of coolant at the piston in each of the plurality of cylinders. The PCJ includes an inlet, an outlet, and a controlled flow passage allowing a substantially continuous flow of coolant to pass from the inlet to the outlet.

14 Claims, 4 Drawing Sheets

INTERNAL COMBUSTION ENGINE INCLUDING PISTON COOLING JETS

INTRODUCTION

The subject disclosure relates to the art of motor vehicles and, more particularly, to a motor vehicle including an internal combustion engine having a piston cooling jet (PCJ).

Internal combustion engines (ICE) rely on pistons to drive a crankshaft coupled to a fly wheel. The flywheel is typically mechanically connected to drive one or more vehicle wheels through a transmission. The piston travels in a cylinder and is driven by products of combustion created by ignition of a fuel such as gasoline, diesel fuel, and the like. The products of combustion create heat that is absorbed by many components of the ICE, including the pistons. Given the exposure to heat, pistons are typically formed from materials that conduct heat, such as aluminum.

Currently, manufacturers are using higher strength materials in forming pistons. The higher strength materials, such as steel, stand up to higher engine loading requirements imposed by, for example, start/stop systems, selective cylinder disabling systems, and the like. While possessing properties that are desirable to withstand higher stress, the higher strength materials also have a lower heat conductivity. The lower heat conductivity make heat removal more difficult using conventional systems. Accordingly, it is desirable to provide a system for removing heat from pistons, particularly those pistons formed from materials having a lower heat conductivity than aluminum.

SUMMARY

Disclosed is an internal combustion engine (ICE) including an engine block including a plurality of cylinders, a piston arranged in each of the plurality of cylinders, and a piston cooling jet (PCJ) mounted to direct a flow of coolant at the piston in each of the plurality of cylinders. The PCJ includes an inlet, an outlet, and a controlled flow passage allowing a substantially continuous flow of coolant to pass from the inlet to the outlet.

In addition to one or more of the features described above or below, or as an alternative, further embodiments could include wherein the PCJ includes an actuator member that selectively transitions between a closed configuration and an open configuration allowing a jet of coolant to flow onto the piston, the controlled flow passage extending through the actuator member.

In addition to one or more of the features described above or below, or as an alternative, further embodiments could include wherein the PCJ includes a spring biasing the actuator member toward the closed configuration.

In addition to one or more of the features described above or below, or as an alternative, further embodiments could include wherein the controlled flow passage extends substantially centrally through the actuator member.

In addition to one or more of the features described above or below, or as an alternative, further embodiments could include wherein the controlled flow passage includes a plurality of controlled flow passages extending through the actuator member.

In addition to one or more of the features described above or below, or as an alternative, further embodiments could include wherein the plurality of controlled flow passages extend about a periphery of the actuator member.

In addition to one or more of the features described above or below, or as an alternative, further embodiments could include wherein the plurality of controlled flow passages collectively define an equivalent hydraulic diameter of between about 1 mm and about 4 mm.

In addition to one or more of the features described above or below, or as an alternative, further embodiments could include wherein the controlled flow passage includes an equivalent hydraulic diameter of between about 1 mm and about 4 mm.

Also disclosed is a method of cooling a piston in an internal combustion engine (ICE) including activating a controller to deliver a pulse of coolant to a piston cooling jet (PCJ), directing the pulse of coolant onto the piston, and passing a continuous flow of coolant to the piston through the PCJ.

In addition to one or more of the features described above or below, or as an alternative, further embodiments could include wherein directing the pulse of coolant include biasing an actuator of the PCJ with a pressure of the pulse of coolant.

In addition to one or more of the features described above or below, or as an alternative, further embodiments could include wherein passing the continuous flow of coolant includes passing a flow of coolant through a controlled flow passage defined by the actuator.

In addition to one or more of the features described above or below, or as an alternative, further embodiments could include wherein passing the flow of coolant through the controlled flow passage includes passing the flow of coolant through a controlled flow passage having an equivalent hydraulic diameter of between about 1 mm and about 4 mm.

In addition to one or more of the features described above or below, or as an alternative, further embodiments could include wherein passing the flow of coolant through the controlled flow passage includes passing the flow of coolant through a plurality of controlled passages defined by the actuator.

In addition to one or more of the features described above or below, or as an alternative, further embodiments could include wherein passing the flow of coolant through a plurality of controlled flow passages includes passing the flow of coolant through a plurality of controlled flow passages having a collective equivalent hydraulic diameter of between about 1 mm and about 4 mm.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
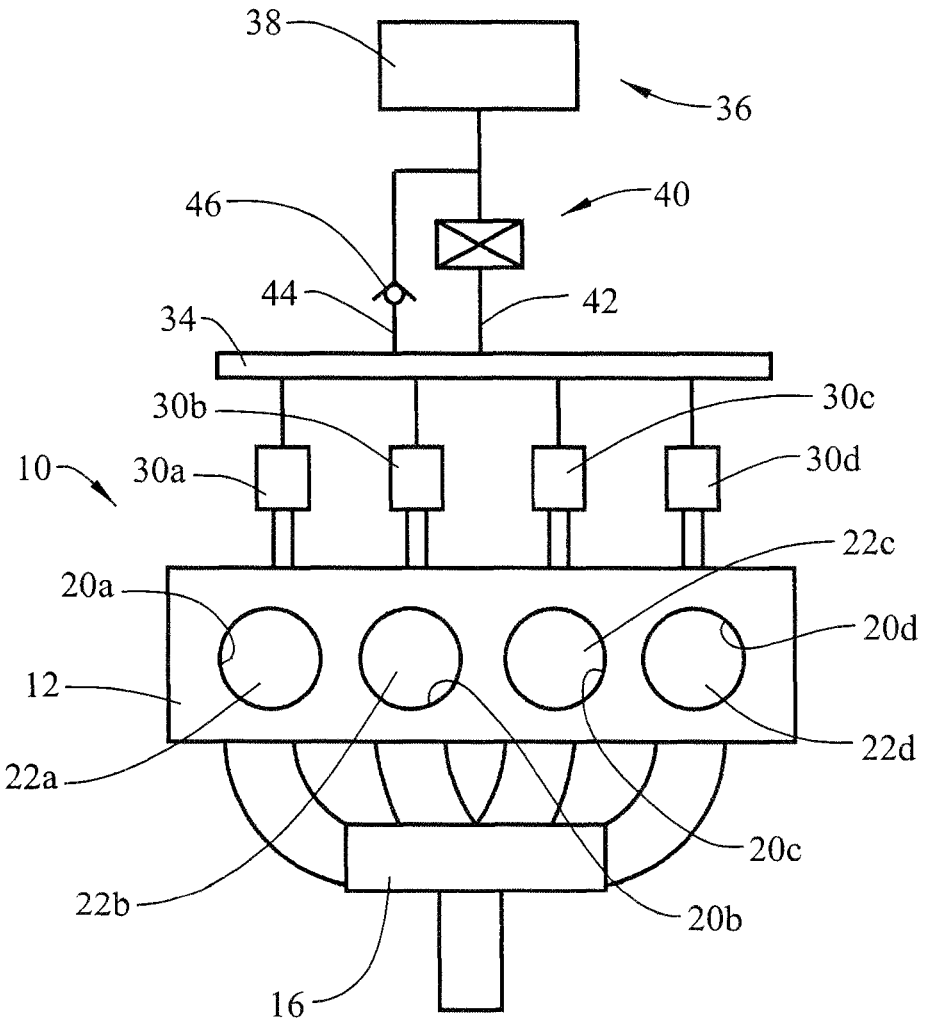
FIG. 1 is schematic view of an internal combustion engine including piston cooling jets, in accordance with an aspect of an exemplary embodiment.

The following description is merely exemplary in nature and is not intended to limit the present disclosure, its application or uses. It should be understood that throughout the drawings, corresponding reference numerals indicate like or corresponding parts and features.

Figure 2:
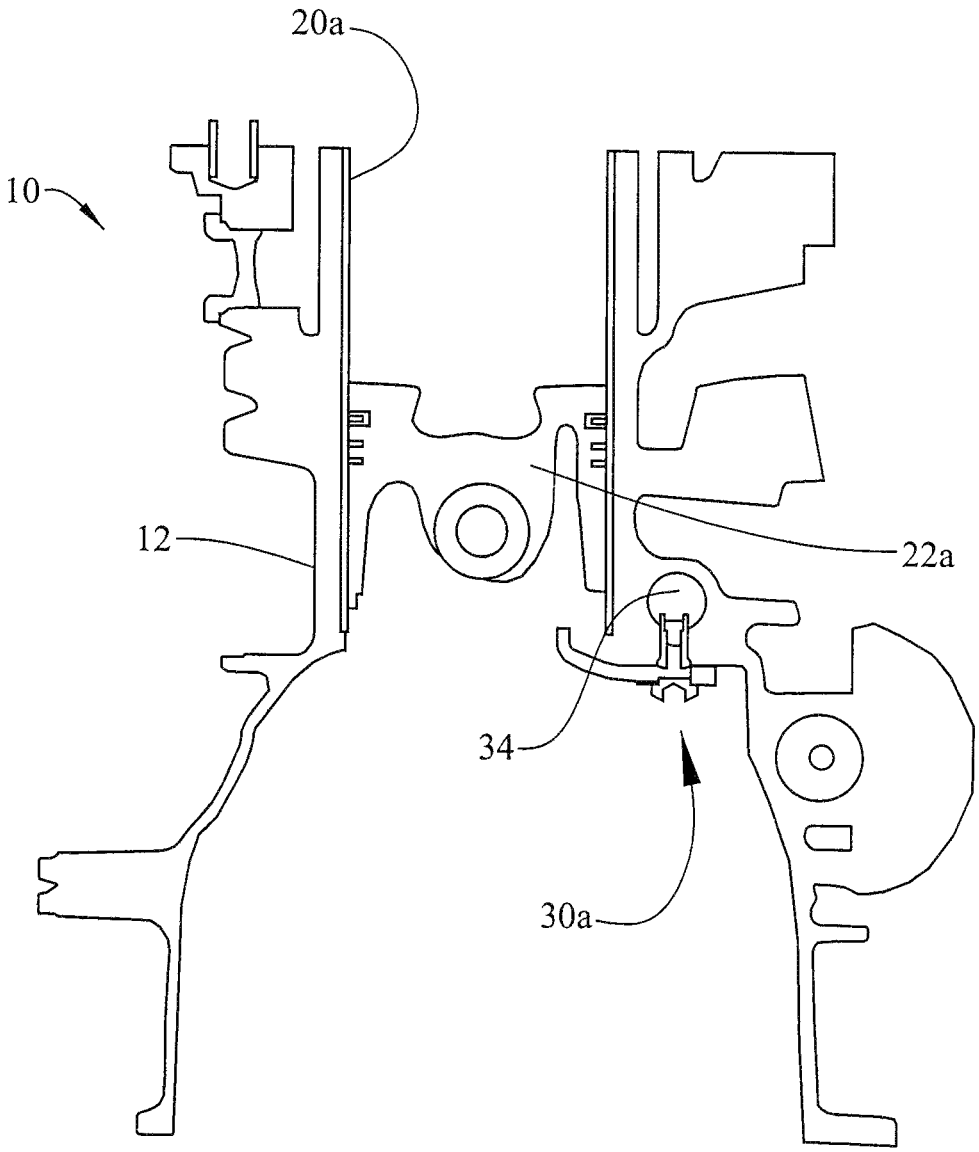
FIG. 2 is a cross-sectional side view of a portion of the internal combustion engine of FIG. 1, in accordance with an aspect of an exemplary embodiment.

An internal combustion engine (ICE), in accordance with an exemplary embodiment, is indicted generally at 10 in FIGS. 1 and 2. ICE 10 includes an engine block 12 that supports an intake manifold (not shown) and an exhaust manifold 16. The intake manifold and exhaust manifold 16 may be connected to a turbocharger (also not shown). Engine block 12 includes a plurality of cylinders 20*a*, 20*b*, 20*c*, and 20*d* that receive a corresponding plurality of pistons 22*a*, 22*b*, 22*c*, and 22*d*. Pistons 22*a*-22*d* move within engine block 12 in response to combustion events produced by the burning of fuel and air. The combustion events produce heat.

In accordance with an exemplary embodiment, engine block 12 supports a plurality of piston cooling jets (PCJ) 30*a*, 30*b*, 30*c*, and 30*d* that are operated to deliver a coolant onto corresponding ones of pistons 22*a*-22*d*. Each PCJ 30*a*-30*d* is fluidically connected to a coolant manifold 34 that is connected to a coolant supply 36. Coolant supply 36, in accordance with an exemplary aspect, stores an amount of lubricant 38 such as oil. A control valve 40 is disposed between coolant supply 36 and coolant manifold 34.

A first passage or conduit 42 connects control valve 40 and coolant manifold 34. First passage 42 may selectively deliver a pulse of coolant into coolant manifold 34 that is directed to each PCJ 30*a*-30*d*. A second passage or conduit 44 also connects control valve 40 and coolant manifold 34. Second conduit 44 may include a one way valve 46 that ensures that coolant does not flow from coolant manifold 34 back towards control valve 40 via second conduit 44. Second conduit 44 allows a continuous supply of coolant to pass into coolant manifold 34. The continuous supply of coolant ensures that a controlled amount of coolant will flow continuously through each PCJ 30*a*-30*d* regardless of a position of control valve 40.

Figure 3:
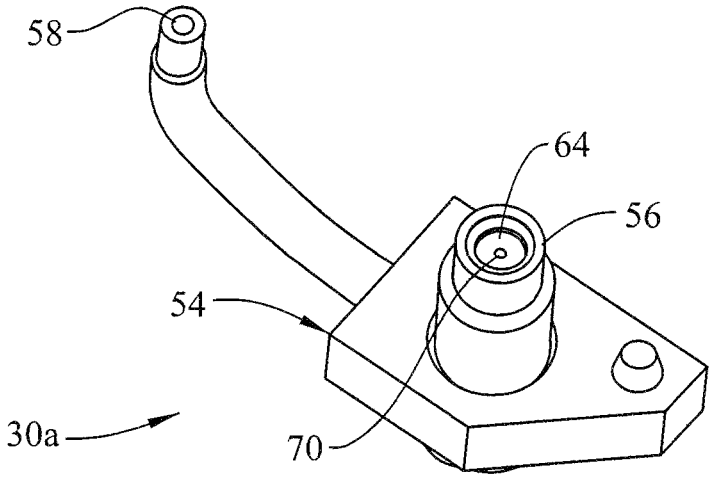
FIG. 3 is a perspective view of a piston cooling jet, in accordance with an aspect of an exemplary embodiment.
Figure 4:
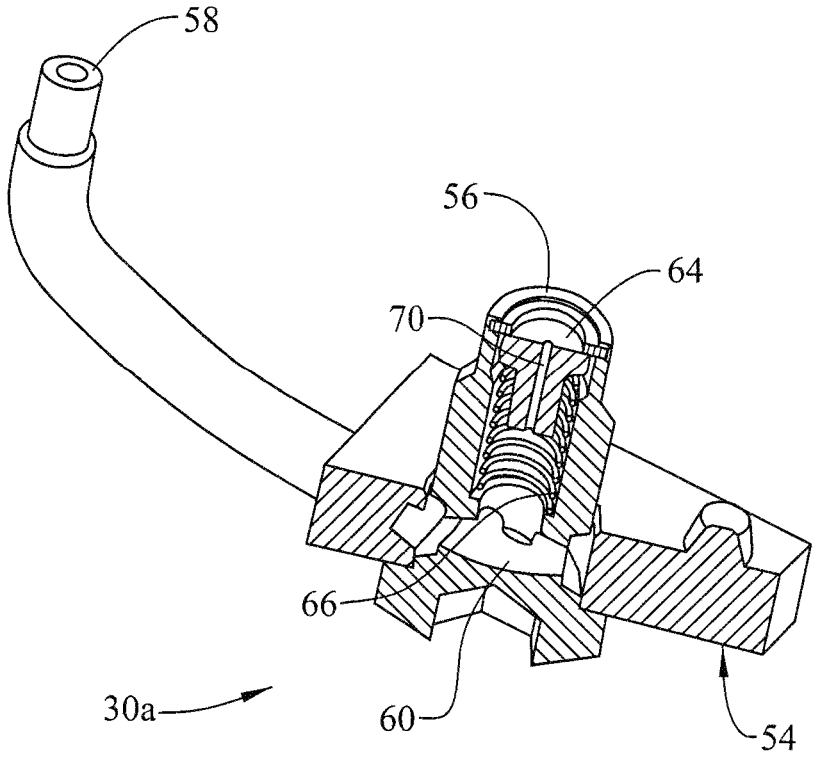
FIG. 4 is a cross-sectional side view of the piston cooling jet of FIG. 3, in accordance with an aspect of an exemplary embodiment.

Reference will now follow to FIGS. 3 and 4 in describing PCJ 30*a* with an understanding that PCJs 30*b*-30*d* may include similar structure. PCJ 30*a* includes a jet body 54 having an inlet 56, an outlet 58 and a flow passage 60 (FIG. 4) extending therebetween. An actuator member 64 is arranged in flow passage 60 and is selectively activated by a momentary increase in coolant pressure created by control valve 40. The momentary increase or "pulse" of coolant pressure causes an amount of coolant, such as lubricant 38, to pass from inlet 56 and be discharged through outlet 58. A biasing member, such as a spring 66 is arranged in flow passage 60 to bias actuator member 64 toward a closed configuration In accordance with an exemplary aspect, actuator member 64 includes a controlled flow passage 70. Controlled flow passage 70 allows a continuous controlled amount of coolant to pass through PCJ 30*a* even when actuator member 64 is biased towards the closed position. The continuous flow of coolant is directed onto piston 22*a* to promote additional heat dissipation that prolongs an overall operational life. In an embodiment, controlled flow passage 70 includes an equivalent hydraulic diameter of between about 1 mm and about 4 mm.

Figure 5:
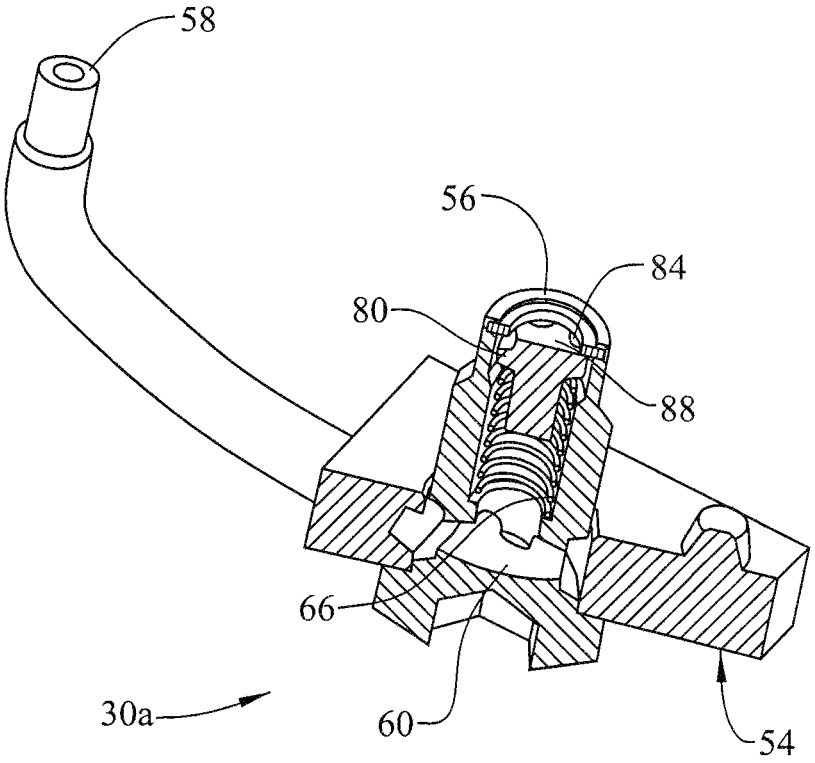
FIG. 5 is a cross-sectional side view of a piston cooling jet, in accordance with another aspect of an exemplary embodiment.
Figure 6:
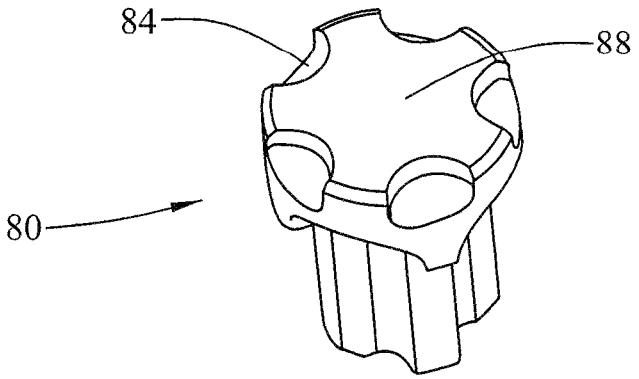
FIG. 6 depicts an actuator of the piston cooling jet of FIG. 5, in accordance with an aspect of an exemplary embodiment.

Reference will now follow to FIGS. 5 and 6, in describing an actuator member 80 in accordance with another aspect of an exemplary embodiment. Actuator member 80 includes a plurality of controlled flow passages 84. The plurality of controlled flow passages 84 extend through actuator member 80. More specifically, the plurality of controlled flow passages extend about a periphery of, and through a top or crown portion 88 of actuator member 80.

The plurality of controlled flow passages 84 allow a continuous controlled amount of coolant to pass through PCJ 30*a* even when actuator member 80 is biased towards the closed position. The continuous flow of coolant is directed onto piston 22*a* to promote additional heat dissipation to prolong an overall operational life. In an embodiment, the plurality of controlled flow passages 84 collectively include an equivalent hydraulic diameter of between about 1 mm and about 4 mm.

The terms "about" and "substantially" are intended to include the degree of error associated with measurement of the particular quantity based upon the equipment available at the time of filing the application. For example, "about" and "substantially" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. An internal combustion engine (ICE) comprising:

an engine block including a plurality of cylinders;

a piston arranged in each of the plurality of cylinders; and a piston cooling jet (PCJ) mounted to direct a flow of coolant at the piston in each of the plurality of cylinders, the PCJ including an inlet, an outlet, an actuator member shiftable between a closed configuration substantially blocking flow through the outlet and an open configuration allowing flow through the outlet, and a controlled flow passage provided at the actuator member, the controlled flow passage allowing a substantially continuous flow of coolant to pass from the inlet to the outlet when the actuator member is in each of the open configuration and the closed configuration.

2. The ICE according to claim 1, wherein the controlled flow passage extends through the actuator member.

3. The ICE according to claim 2, wherein the PCJ includes a spring biasing the actuator member toward the closed configuration.

4. The ICE according to claim 2, wherein the controlled flow passage extends substantially centrally through the actuator member.

5. The ICE according to claim 2, wherein the controlled flow passage includes a plurality of controlled flow passages extending through the actuator member.

6. The ICE according to claim 5, wherein the plurality of controlled flow passages extend about a periphery of the actuator member.

7. The ICE according to claim 5, wherein the plurality of controlled flow passages collectively define an equivalent hydraulic diameter of between about 1 mm and about 4 mm.

8. The ICE according to claim 1, wherein the controlled flow passage includes an equivalent hydraulic diameter of between about 1 mm and about 4 mm.

9. A method of cooling a piston in an internal combustion engine (ICE) comprising:

activating a controller to shift an actuator member from a closed configuration to an open configuration to deliver a pulse of coolant to a piston cooling jet (PCJ);

directing the pulse of coolant onto the piston; and passing a continuous flow of coolant to the piston through the PCJ when the actuator member is in the closed configuration.

10. The method of claim 9, wherein directing the pulse of coolant include biasing the actuator of the PCJ with a pressure of the pulse of coolant.

11. The method of claim 10, wherein passing the continuous flow of coolant includes passing a flow of coolant through a controlled flow passage defined by the actuator.

12. The method of claim 11, wherein passing the flow of coolant through the controlled flow passage includes passing the flow of coolant through a controlled flow passage having an equivalent hydraulic diameter of between about 1 mm and about 4 mm.

13. The method of claim 11, wherein passing the flow of coolant through the controlled flow passage includes passing the flow of coolant through a plurality of controlled passages defined by the actuator.

14. The method of claim 13, wherein passing the flow of coolant through a plurality of controlled flow passages includes passing the flow of coolant through a plurality of controlled flow passages having a collective equivalent hydraulic diameter of between about 1 mm and about 4 mm.

* * * * *